US012339088B1

(12) United States Patent
Hanson et al.

(10) Patent No.: US 12,339,088 B1
(45) Date of Patent: Jun. 24, 2025

(54) SPOOL VALVE ASSEMBLY FOR AIR GUN

(71) Applicant: Crosman Corporation, Bloomfield, NY (US)

(72) Inventors: Jeffrey D. Hanson, Honeoye Falls, NY (US); Ethan T. Butterfield, Ontario, NY (US)

(73) Assignee: Crosman Corporation, Bloomfield, NY (US)

( * ) Notice: Subject to any disclaimer, the term of this patent is extended or adjusted under 35 U.S.C. 154(b) by 0 days.

(21) Appl. No.: 18/595,242

(22) Filed: Mar. 4, 2024

(51) Int. Cl.
*F41B 11/721* (2013.01)
*F41B 11/723* (2013.01)

(52) U.S. Cl.
CPC ..... *F41B 11/723* (2013.01)

(58) Field of Classification Search
CPC ..... F41A 21/10; F41A 11/02; F41A 21/484; F41B 11/62; F41B 11/52; F41B 11/55; F41B 11/721; F41B 11/54; F41B 11/722; F41B 11/723
USPC ..... 124/73, 41.1, 45, 49, 63, 71, 72, 74, 76, 124/82, 75, 77
See application file for complete search history.

(56) References Cited

U.S. PATENT DOCUMENTS

| | | | | |
|---|---|---|---|---|
| 6,857,422 | B2 * | 2/2005 | Pedicini | F04B 9/02 124/63 |
| 7,150,276 | B1 * | 12/2006 | Rice | F41B 11/723 124/73 |
| 8,413,644 | B2 * | 4/2013 | Masse | F41B 11/73 124/76 |
| 11,378,352 | B1 * | 7/2022 | Hanson | F41B 11/54 |
| 11,709,032 | B2 * | 7/2023 | Hanson | F41A 17/82 124/75 |
| 2009/0241931 | A1 * | 10/2009 | Masse | F41B 11/71 124/76 |
| 2022/0228835 | A1 * | 7/2022 | Hanson | F41B 11/54 |
| 2022/0333894 | A1 * | 10/2022 | Hanson | F41A 17/82 |
| 2024/0053118 | A1 * | 2/2024 | Hanson | F41B 11/54 |

* cited by examiner

*Primary Examiner* — Michael D David
(74) *Attorney, Agent, or Firm* — Lee & Hayes, P.C.

(57) ABSTRACT

An air gun includes a barrel through which a projectile is fired, and a chamber fluidly connected to the barrel. The air gun also includes a valve assembly including a valve body, a primary spool, and a secondary spool.

20 Claims, 10 Drawing Sheets

SPOOL VALVE ASSEMBLY FOR AIR GUN

BACKGROUND

Air guns are used for a variety of recreational purposes. Some conventional air guns include a tank or reservoir that is charged (e.g., pre-charged) to provide a number of shots before re-charging. These pre-charged pneumatics (PCPs) are able to supply air "on-demand," e.g., for ready firing. PCPs generally include valve assemblies that meter an amount of the compressed air from the tank/reservoir for firing of the air gun. These valve assemblies are often complex, lead to air gun failure, and/or cause a pressure reduction that limits the power with which the air gun fires a projectile. Thus, there is a need in the art for an improved valve assembly, which may be used with a PCP or other type of on-demand air gun.

BRIEF DESCRIPTION OF THE DRAWINGS

The detailed description is described with reference to the accompanying figures. In the figures, the left-most digit of a reference number identifies the figure in which the reference number first appears. The same reference numbers in different figures indicate similar or identical items.

DETAILED DESCRIPTION

Figure 1:
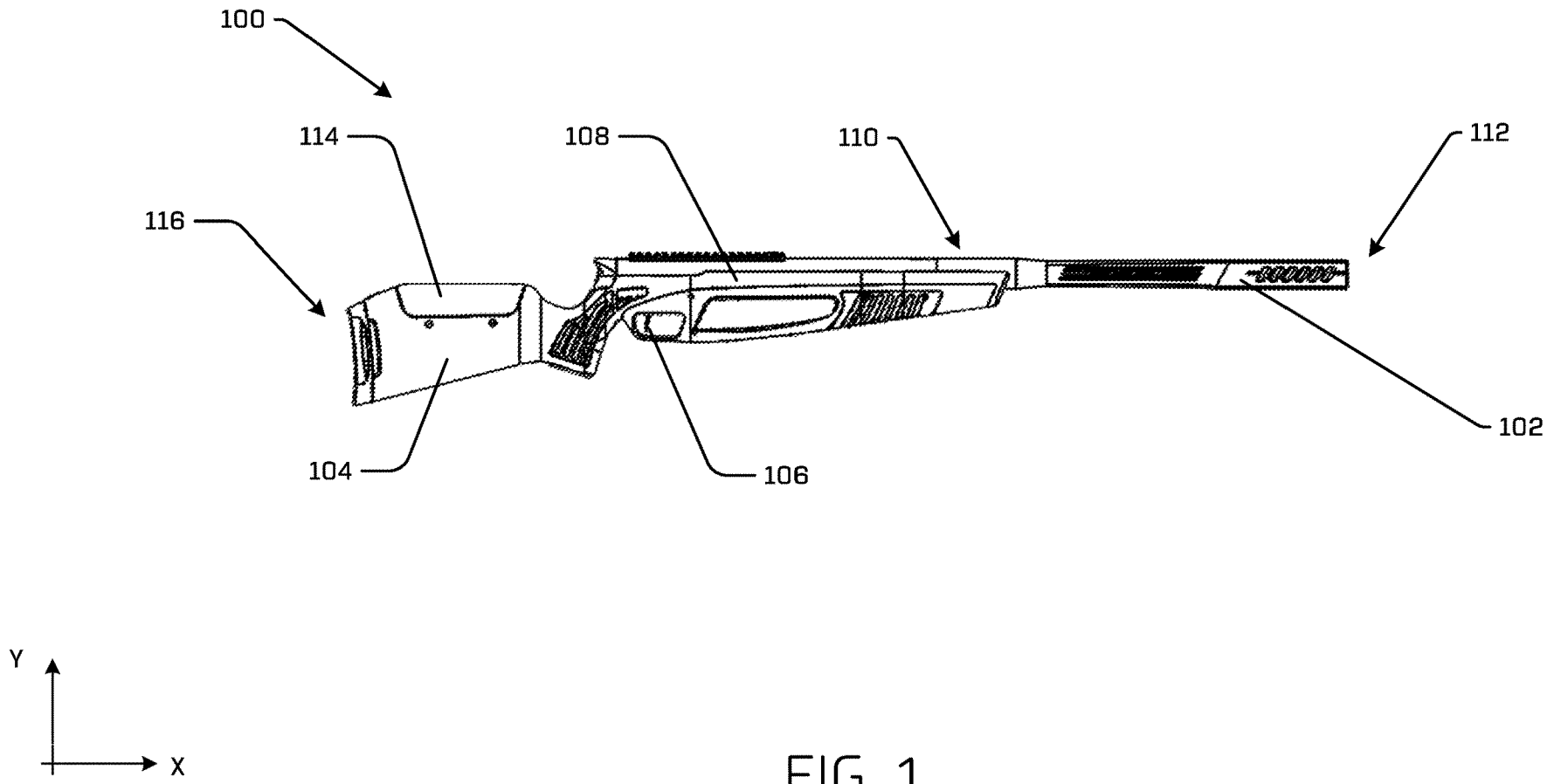
FIG. 1 is side view of an example air gun according to example implementations of this disclosure.

This application relates to a valving assembly for use with an air gun or other projectile launching device. In examples, trigger assemblies disclosed herein may be used in a pre-charged pneumatic (PCP) or other compressed air gun. The systems and techniques described herein may provide for an improved valving system that may improve firing characteristics for the PCP air gun.

Aspects of this disclosure relate to a valve assembly for use with an air gun. In examples, the valve assembly may be configured to selectively pass compressed air from a compressed air source (e.g., an on-board air source) to a barrel of the air gun to fire a projectile. In some examples, the valve assembly can include a compressed air volume, a valve, a primary spool, and a secondary spool. In examples, the primary spool and the secondary spool may be configured to move relative to each other, e.g., during cocking and/or firing of the gun. During cocking, the primary spool may restrict flow of compressed air through the valve. Once cocked, the primary spool and the secondary spool may define a passageway between the compressed air volume. Firing the air gun, e.g., by pulling a trigger, can release the compressed air, via the valve, from the compressed air volume.

In some aspects of this disclosure, the valve may include a substantially cylindrical valve body formed about a valve axis. The valve may define one or more passageways that facilitate passage of the compressed air volume into a channel defined by the primary spool and/or secondary spool. In some examples, the passageways can be formed as opening through a sidewall of a body of the valve. For instance, these passageways can be angled relative to a firing or valve axis. In other examples, the passageways can be formed as channels. For example, the channels can be formed as slots or other elongate openings. In some examples, the channels may be substantially parallel to the firing or valve axis.

The primary spool may extend along the valve axis and may be movable relative to the valve body to selectively allow or prevent air from the compressed air volume to pass through the one or more passageways. For example, in a first position the primary spool can block the passageways and in a second position the primary spool can be spaced from, or expose, the passageways to allow air to flow from the compressed air volume toward the barrel.

The secondary spool may extend along the valve axis and may be movable along the valve axis relative to the primary spool. In some examples, the secondary spool may be disposed at least partially inside the primary spool. During cocking, the primary spool may be actuated, e.g., by a user interface, and may contact or drive the primary spool into a cocked position covering the fluid passageways. In some examples, the secondary spool may also comprise a leading surface that contacts the barrel or otherwise cooperates with the barrel to provide a passageway through which compressed air can pass to the barrel.

In examples of this disclosure, the one or fluid passageways, the primary spool and the secondary spool can define a fluid path through which compressed air form the compressed air volume is passed to the barrel. In examples, the fluid path may have a substantially constant cross-sectional area, e.g., such that none of the fluid passageways, the primary spool and/or the secondary spool substantially restrict the flow of compressed gas therethrough. This may be unlike some conventional valving systems, which may substantially restrict air flow between a fluid reservoir and the barrel. In some examples, the techniques and systems described herein, by not restricting the flow of compressed gas, can provide better shot characteristics, e.g., higher shot velocity, or the like.

Thus, systems and techniques described herein may facilitate firing of an air gun using a valve assembly. Specific examples of this disclosure are provided below with reference to the figures. Although the specific examples described reference use of a valve assembly with a PCP air gun, aspects of this disclosure can be used with other types of air guns. Without limitation, the valve assemblies described herein may provide firing for any number of projectile launchers.

FIG. 1 illustrates an example PCP air gun 100 according to aspects of this disclosure. More specifically, FIG. 1 is a side view of one implementation of the air gun 100, which includes a trigger assembly for self-cocking and firing via an improved trigger assembly. FIG. 1 illustrates the air gun 100 as generally including a barrel 102, a stock 104, and a trigger 106. The air gun 100 also includes a housing 108 extending generally between the barrel 102 and the stock 104. The housing 108 may retain and/or conceal components of the air gun 100, including a trigger assembly, which includes the trigger 106. Without limitation, aspects of this disclosure include components for self- or automatic-cocking of the air gun 100 using the trigger assembly, which may be disposed in, attached to, or otherwise associated with the housing 108. In aspects of this disclosure, the housing 108 may be any portion of the air gun 100 that contains, retains, mounts, or otherwise couples to other aspects of the air gun. In some examples, the housing may be a portion of the air gun 100 that conceals, covers, and/or shrouds other aspects of the air gun. For example, the housing 108 can include some or all of the stock 104, the barrel 102, and/or a central body of the air gun between the stock 104 and/or the barrel.

The barrel 102 extends generally from a breech end 110 to a muzzle end 112. Although not illustrated in FIG. 1, a bore extends through the barrel 102, from the breech end 110 to the muzzle end 112. The bore provides a hollow interior space within the barrel 102 through which compressed air and a projectile, such as a pellet, can pass, as will be described in greater detail below. The barrel 102 is sufficiently strong to contain high pressure gasses introduced into the barrel 102 to fire the projectile. In implementations, the bore may be smooth, or the bore may be rifled, e.g., to impart a stabilizing spin on the projectile as it passes through the bore.

The stock 104 may be any conventional size or shape. In some instances, the stock 104 may be removably secured to the housing, e.g. to promote removal and/or replacement of the stock 104. Moreover, removal of the stock 104 may facilitate access to an interior of the housing 108, e.g., to service working components of the air gun 100. The stock 104 may also house a battery or other power source, a control system adapted to receive inputs from sensors and/or to generate outputs that drive motors, actuators, lights, solenoids, motors, linear actuators and/or other electronic, mechanical, electromechanical, sonic, electrooptical, and/or other components. Without limitation, the stock 104 may comprise a portion of the housing 108.

The trigger 106 may be any lever, button, or the like, configured for user interaction to fire the air gun 100. As detailed further herein, in some instances the trigger 106 may be a user input that facilitates movement of a spool valve to allow compressed air to pass from a compressed gas reservoir down the barrel 102 to fire a projectile. A trigger assembly including the trigger 106 may also or alternatively prevent firing of the air gun 100 while the air gun 100 is presenting a new projectile for firing, e.g., after firing a projectile.

The housing 108 is generally provided to contain components of the air gun 100. For instance, and as detailed further below, the housing 108 may contain, support, and/or conceal aspects that facilitate action of the air gun 100. The shape and size of the housing 108 in FIG. 1 is for illustration. Other shapes, sizes, and compositions are contemplated. Components of the housing may be made of any conventional materials, including but not limited to, metal, such as aluminum, or polymers.

FIG. 1 also illustrates that the stock 104 can include one or more removable sections 114, 116. For example, the removable sections 114, 116 can be movable relative to the stock 104 to provide access to an interior of the air gun 100. Without limitation, the interior of the air gun 100 can include a reservoir of compressed air, and removal of one of the removable sections 114, 116 may facilitate replacement or recharging of the reservoir. The removable section 114, 116 can also, or alternatively, facilitate access to other components of the air gun 100, e.g., for repair, replacement, maintenance, modification, or the like.

Figure 2:
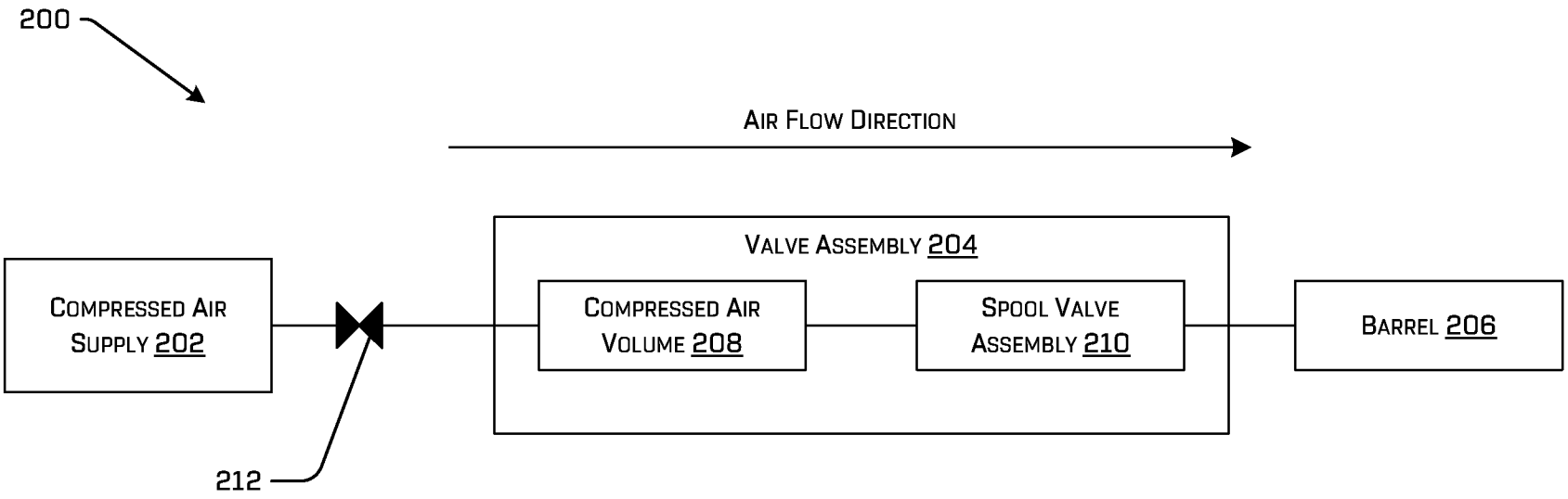
FIG. 2 is a schematic representation of an air gun according to example implementations of this disclosure.

FIG. 2 is a schematic representation of aspects of an air gun 200, which may be the air gun 100. In more detail, FIG. 2 shows that the air gun 200 generally includes a compressed air supply 202, a valve assembly 204, and a barrel 206, which may be the barrel 102 discussed above.

The compressed air supply 202 may be any source of compressed air. Without limitation, the compressed air supply 202 may be a pre-charged canister (such as a compressed air canister), a cartridge (such as a CO2 cartridge), a rechargeable reservoir, or the like. In examples, the compressed air supply 202 may be configured to retain an amount of the compressed air that is sufficient to allow the air gun to fire one or more projectiles, e.g., after (re-)cocking, (re-)loading, and/or other operations required to fire the air gun. In examples, the compressed air supply may be replaceable, refillable, and/or otherwise configured to allow for the addition of compressed air, e.g., to facilitate re-use of the air gun.

The valve assembly 204 is configured to selectively allow compressed air, e.g., from the compressed air supply 202, to escape from the air gun via the barrel 206 to fire a projectile through the barrel 206. In the example of FIG. 1, the valve assembly 204 includes a compressed air volume 208 and a spool valve assembly 210.

The compressed air volume 208 is configured to receive, from the compressed air supply 202, an amount of the compressed air. The amount of the compressed air may a predetermined amount defined at least in part by a configuration, size, shape, and/or other attribute of the compressed air volume 208. In an example, the compressed air volume 208 may retain an amount of compressed air that is desired to fire a single projectile from the barrel 206, as described further herein. In some examples, aspects of the compressed air may be configurable, including but not limited to a pressure of the compressed air in the compressed air volume 208. As will be appreciated, the compressed air volume 208 may be configured to receive and retain a portion of the compressed air retained in the compressed air supply 202.

As also illustrated in FIG. 2, the air gun can also include a fill valve 212 disposed between the compressed air supply 202 and the compressed air volume 208. The fill valve 212 may be selectively opened and closed to, respectively, allow or prevent flow of compressed air from the compressed air supply 202 to the compressed air volume 208. In some examples, the fill valve may be a passive valve, e.g., that automatically opens to allow air to flow from the compressed air supply 202 in response to a decrease in pressure in the compressed air volume 208 (e.g., resulting from a release of the air in the compressed air volume 208 by the spool valve assembly 210 to fire the air gun). In some examples, aspects of the fill valve 212 may be adjustable, e.g., to alter a pressure of the air in the compressed air volume 208. For example, the fill valve 212 may comprise a regulator.

The fill valve 212 may also be configured to inhibit the flow of compressed air from the compressed air volume 208 toward the compressed air supply 202, e.g., upstream. Without limitation, the fill valve 212 can be closed (and in some examples remain closed), while the air gun 200 is fired, such that substantially all of the compressed air in the compressed air volume 208 is evacuated form the air gun via the barrel 206. In examples, the fill valve 212 may be controlled to open after this evacuation occurs, e.g., to refill the compressed air volume 208 to ready the air gun 200 for another shot. For instance, after a shot is fired, the spool valve assembly 210 may close, e.g., to prevent further flow of compressed air through the valve assembly 204 and to the barrel 206, and the fill valve 212 may then be opened to allow for filling of the compressed air volume 208.

The spool valve assembly 210 is configured to selectively allow for release of the compressed air in the compressed air volume 208. As illustrated by the air flow direction in FIG.

2, the spool valve assembly 210 is downstream of the compressed air volume 208, such that selective opening of the spool valve assembly 210 causes air in the compressed air volume 208 to pass through the spool valve assembly 210 and exit the air gun via the barrel 206. When a projectile is placed in the barrel or proximate an opening of the barrel, the air exiting the air gun via the barrel 206 will cause the projectile to be fired by the air gun. In examples, the barrel 206 may be the barrel 102 discussed above.

In examples described further herein, the spool valve assembly 210 may provide improvements over conventional valve assemblies used in air guns. For example, the spool valve assembly 210 may provide for increased air flow from the compressed air volume 208 to the barrel 206. Some conventional valves used in air guns act to overly restrict flow, e.g., by using relatively small orifices and/or tortuous paths through which the compressed air must pass to the barrel. Aspects of the present spool valve assembly 210 may provide for a more direct and/or substantially unrestricted flow path through which air from the compressed air volume 208 may pass through to the barrel 206. These and additional features and/or benefits of this disclosure will now be described with reference to an example shown in FIGS. 3A-3F.

FIGS. 3A-3F are side views of aspects of a valve assembly 300 that may be incorporated in the air gun 100. For example, the valve assembly 300 may be an example of the valve assembly 204 shown schematically in FIG. 2. More specifically, FIGS. 3A-3F show a progression of firing, cocking, searing, and loading, the air gun 100, e.g., using the valve assembly 300.

Figure 3A:
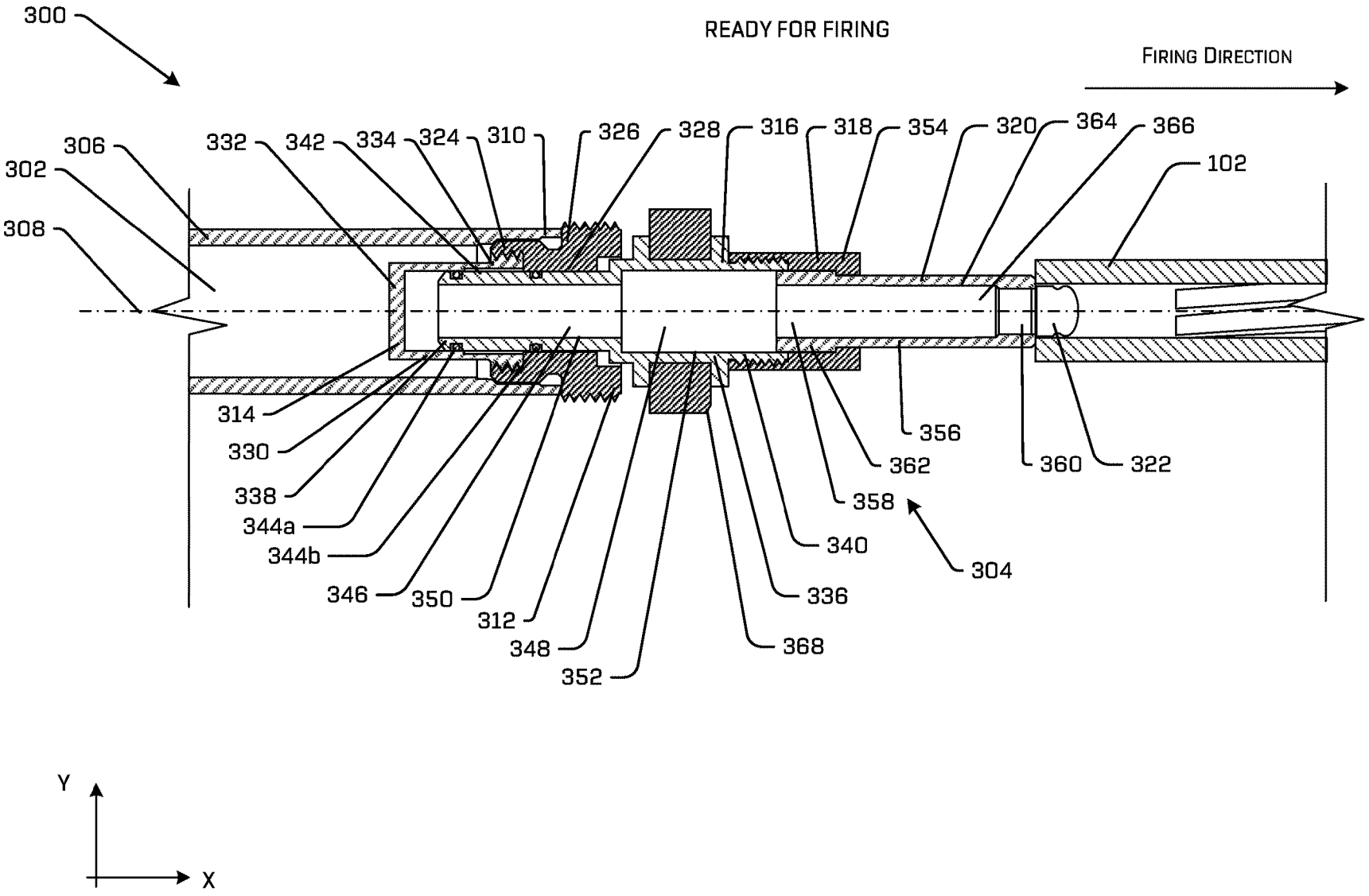
FIGS. 3A through 3F are side elevation views of aspects of a valve assembly illustrating steps of cocking, searing, loading, and firing of an air gun according to example embodiments of the present disclosure.

Referring first to FIG. 3A, the valve assembly 300 is illustrated as including a compressed air volume 302 and a spool valve assembly 304, which may generally correspond to the compressed air volume 208 and the spool valve assembly 210 discussed above, respectively. The compressed air volume 302 in FIG. 3A is at least partly defined by a cylindrical sidewall 306 extending generally along a longitudinal axis 308. The cylindrical sidewall 306 extends between a first, open end from a first end 310, generally closer to the barrel 102, to an opposite, second end, not shown in FIG. 3A. The sidewall 306, the first end 310, and the second end generally define, at least in part, the compressed air volume 302. Although the compressed air volume 302 is generally illustrated as being formed by a cylinder, e.g., in which the sidewall 306 is a cylindrical sidewall, aspects of this disclosure are not limited to any specific shape or configuration. In examples, the sidewall 306 can comprise more than a single sidewall, e.g., angled or otherwise positioned relative to each other. In examples, the compressed air volume 302 may defined by any structure, component, assembly, or the like, that creates the compressed air volume 302 as an enclosed or substantially enclosed volume capable of retaining compressed air, as detailed further herein.

Although not shown in FIG. 3A, the compressed air volume 302 is in fluid communication with a compressed air supply, e.g., the compressed air supply 202 discussed above. In examples, one or more conduits, valves, and/or other components may be provided to facilitate transfer of compressed air from the compressed air supply to the compressed air volume 302.

The spool valve assembly 304 generally includes a valve collar 312, a valve body 314, a first, primary, or main spool 316, a spool mount 318, and a second, secondary, or feed spool 320. As detailed further herein, the spool valve assembly 304 is configured to selectively allow the compressed air contained in the compressed air volume 302 to pass through the spool valve assembly 304 and escape through the barrel 102, forcing a pellet or other projectile 322 disposed in the firing path of the barrel 102 to be fired from the barrel 102. In some examples, substantially all of the compressed air in the compressed air volume 208 escapes during the firing of the air gun.

The valve collar 312 is configured to mount the valve body 314 relative to the compressed air volume 302. In the illustrated example, the valve collar 312 is coupled proximate the first end 310 of the sidewall 306. Specifically, in the illustrated example, the first end 310 of the sidewall 306 forms an opening. The valve collar 312 has a first end 324 that is at least partially disposed in the opening, e.g., such that at least a portion of the first end 324 of the valve collar 312 is circumscribed by the sidewall 306 proximate the first end 310. The valve collar 312 also has a flanged second end 326 that has an outer diameter larger than a diameter of the opening at the first end 310 of the sidewall 306. As illustrated in FIG. 3A, the second end 326 of the valve collar 312 contacts an edge of the first end 310.

In examples of this disclosure, the valve collar 312 may be fixed to the sidewall 306. In examples, the valve collar 312 may be fixed to the sidewall 306 in a sealing manner, e.g., such that air in the compressed air volume 302 cannot escape between the sidewall 306 and the valve collar 312. For example, the first end 324 of the valve collar 312 may be configured for press fitting relative to the sidewall 306. The second end 326 of the valve collar 312 is illustrated in FIG. 3 as including external threads, which may be configured to cooperate with internal threads of a collar or other joining component. In still other examples, the sidewall the valve collar 312 may be configured for threading directly to the sidewall 306. Other configurations in which the valve collar 312 is coupled and/or sealed relative to the sidewall 306 also are contemplated.

As also illustrated in FIG. 3A, the valve collar 312 defines an interior surface 328. The interior surface 328 is illustrated as a cylindrical surface, e.g., defining a cylindrical, longitudinal opening through the valve collar 312. As detailed further below, the main spool 316 is sized to move relative to the valve collar 312 in the longitudinal opening defined by the valve collar 312.

The valve body 314 is coupled to the valve collar 312. More specifically, in the example of FIG. 3A, the valve body 314 has a substantially cylindrical sidewall 330 extending longitudinally between a closed end 332 and an open end 334. In the example illustrated, the open end 334 of the valve body 314 has first (external) threads that cooperate with second (internal threads at the first end 324 of the valve collar 312. This threaded coupling is for example only. Any coupling that facilitates coupling of the valve body 314 to the valve collar 312 in such a way that seals the valve body 314 relative to the valve collar 312, e.g., such that air in the compressed air volume 302 cannot pass through an interface of the valve body 314 and the valve collar 312 may be used. In some examples, the valve body 314 may be formed integrally with the valve collar 312, e.g., as a single piece.

In the illustrated embodiment of FIG. 3A, the valve body is substantially cylindrical. However, this shape is not required. As detailed further herein, the valve body 314 may be disposed at least partially in the compressed air volume 302 and may include features that, when the air gun is fired, allow for air to exit the compressed air volume 302 via the valve body 314 and/or the valve collar 312. Other shapes and configurations may also achieve these ends, as will be appreciated by those having ordinary skill in the art, with the benefit of this disclosure.

As also illustrated in FIG. 3A, the sidewall 330 of the valve body 314 defines an interior surface. The interior surface is illustrated as a cylindrical surface, e.g., defining a cylindrical, longitudinal opening through the valve body 314, terminating at the closed end 332. As detailed further below, the main spool 316 is sized to move relative to the valve body 314 in the longitudinal opening defined by the valve collar 312. In examples, the opening defined by the sidewall 330 of the valve body 314 may have the same diameter (or internal profile) as the inner surface 328 of the valve collar 312. Thus, in some examples, the inner surface of the sidewall 330 of the valve body 314 and the inner surface 328 of the valve collar 312 may define a substantially continuous, longitudinal opening through a portion of the valve body 314 and the valve collar 312.

The main spool 316 is illustrated in FIG. 3A as having a generally elongate body 336 extending along the longitudinal axis 308 between a first end 338, relatively closer to the compressed air volume 302, and a second end 340, relatively closer to the barrel 102. As detailed further herein, the main spool 316 is configured for movement relative to the valve collar 312 and the valve body 314.

Proximate the first end 338, the main spool 316 has an outer surface that is configured to be received in the opening defined by the inner surface 328 of the valve collar 312 and the inner surface of the valve body 314. As also shown in FIG. 3A, the outer surface 342 of the main spool 316 may include features, e.g., cutouts, for retaining a first seal 344*a* and a second seal 344*b*. The first seal 344*a* is relatively closer to the first end 338 and the second seal 344*b* is spaced longitudinally from the first seal 344*a* on a side of the first seal 344*a* opposite the first end 338. Although the seals 344*a*, 344*b* are illustrated as being disposed on (and fixed relative to) the outer surface 342 of the main spool 316, in other arrangements one or both of the seals 344*a*, 344*b* may be fixed relative to the valve collar 312 and/or the valve body 314. As will be appreciated from this disclosure, the seals 344*a*, 344*b* represent a sealing arrangement that prevents compressed air from passing between the outer surface 342 of the main spool 316 and the valve collar 312 and valve body 314.

In the example of FIG. 3A, the body 336 of the main spool 316 is stepped. Specifically, proximate the second end 340, the body 336 has an outer diameter that is larger than the outer diameter of the outer surface 344 proximate the first end 338. As illustrated, this change in size creates a stepped outer surface. As also illustrated in FIG. 3A, and detailed further below, the valve collar 312 may include a bore proximate the second end 326 that is sized to receive a portion of the stepped outer surface of the body 336.

The body 336 of the main spool 316 may also be stepped to facilitate a varied internal volume. Specifically, as shown in FIG. 3A, the main spool 316 has a first main spool volume 346 proximate the first end 338 and a second main spool volume 348 proximate the second end 340. As illustrated, the first main spool volume 346 is defined at least in part by a first inner surface 350 of the main spool 316, and the second main spool volume 348 is defined at least in part by a second inner surface 352 of the main spool 316. In examples, the first inner surface 350 has a first diameter smaller than a second diameter of the second inner surface 352. In the example of FIG. 3A, the first main spool volume 346 and the second main spool volume 348 are arranged coaxially, e.g., with the first main spool volume 346 being in fluid communication with (e.g., opening into) the valve body 314, and the second main spool volume 348 being downstream of the first main spool volume 346.

Proximate the second end 340 of the main spool 316, external threads are provided to facilitate threaded attachment of the spool mount 318. Although a threaded attachment is shown, in other examples the spool mount 318 may otherwise be coupled to the main spool 316. The spool mount 318 is configured to retain the feed spool 320 relative to the main spool 316 in a manner that allows for relative movement of the feed spool 320 and the main spool 316, as discussed further herein.

In more detail, the spool mount 318 has a generally cylindrical body that extends from a first end that is coupled to the main spool 316, e.g., using threads as shown, and a second end 354. The spool mount 318 also defines an inner surface that generally corresponds in size, profile and/or shape with the second inner surface 352 of the main spool 316. In examples, a portion of the spool mount 318 may extend or otherwise define a portion of the second main spool volume 348. The spool mount 318 also includes a reduced diameter portion proximate the second end 354. As illustrated, the second end 354 of the spool mount 318 defines an opening that is relatively smaller, e.g., has a smaller diameter, than the diameter of the second main spool volume 348. As discussed further herein, the smaller opening at the second end 354 of the spool mount 318 may cooperate with a flanged outer surface of the feed spool 320, to restrict movement of the feed spool 320 relative to the main spool 316 and/or to prevent unwanted separation of the feed spool 320 and the main spool 316.

The feed spool 320 is a generally elongate member having a sidewall 356 extending between a first open end 358 and a second open end 360. Proximate the first open end 358, the sidewall 356 includes a flanged surface 362 that has a relatively larger diameter than a remainder of the sidewall 356. As noted above, the flanged surface 362 may have a diameter that is larger than a diameter of the opening at the second end 354 of the spool mount 318. However, the remainder of the sidewall 356 has a diameter that is smaller than the diameter of the opening at the second end 354 of the spool mount 318. In this manner, the flanged surface 362 and the spool mount 318 cooperate to limit travel of the feed spool in a firing direction, e.g., toward the barrel 102, along the longitudinal axis 308.

The feed spool 320 also has an inner surface 364 that generally defines a feed spool volume 366. In examples, the inner surface 364 of the feed spool 320 may have a diameter that is substantially the same as a diameter of the first inner surface 350 of the main spool 316 and/or an inner diameter of the barrel 102. As detailed herein, when these diameters are substantially the same, a channel through which compressed air flows to fire the air gun may be relatively unrestricted, which may facilitate improved power, accuracy, reliability, repeatability, and/or the like.

In the example of FIG. 3A, the inner surface 364 of the feed spool 320 has a slightly reduced diameter proximate the second end 360. As illustrated, the reduced diameter of the inner surface 364 may provide for addition material proximate the second end 360, such that the opening at the second end 360 is relatively smaller than an outer diameter of the projectile 322. As discussed further herein, the second end 360 of the feed spool can thus provide a surface that may push or otherwise direct the projectile 322 into the barrel 102 for firing. Other components and features of the valve assembly 300 will be introduced and detailed in connection with FIGS. 3B-3F.

In the example of FIG. 3A, the air gun including the valve assembly 300 may be in a configuration corresponding to a ready for firing configuration. In this examples, the main spool is in a rearward or cocked position that prevents air from escaping the compressed air volume 302 via the valve body 314. Although not illustrated in FIG. 3A, a trigger assembly associated with the air gun can include a sear that is configured to contact a searing surface 368 coupled to the main spool 316. For example, the searing surface 368 may be a leading edge or surface that is fixed to the main spool 316. The sear may be configured to selectively engage the searing surface 368 to prevent movement of the main spool 316 in the firing direction. As discussed further herein, the pressure in the compressed air volume 302 may act on the main spool 316 to bias the main spool 316 in the firing direction. The sear, contacting the searing surface 368, will counter this biasing force to retain the main spool 316 in the illustrated position. Accordingly, in the illustrated position, the compressed air volume 302 may be filled to a predetermined air pressure, e.g., via a compressed air supply (not shown in FIG. 3A). Also in the configuration of FIG. 3A, the feed spool 320 is in a forward position in which the second end 360 of the feed spool 320 contacts the barrel 102, and a projectile 322 is loaded into the barrel 102.

Figure 3B:
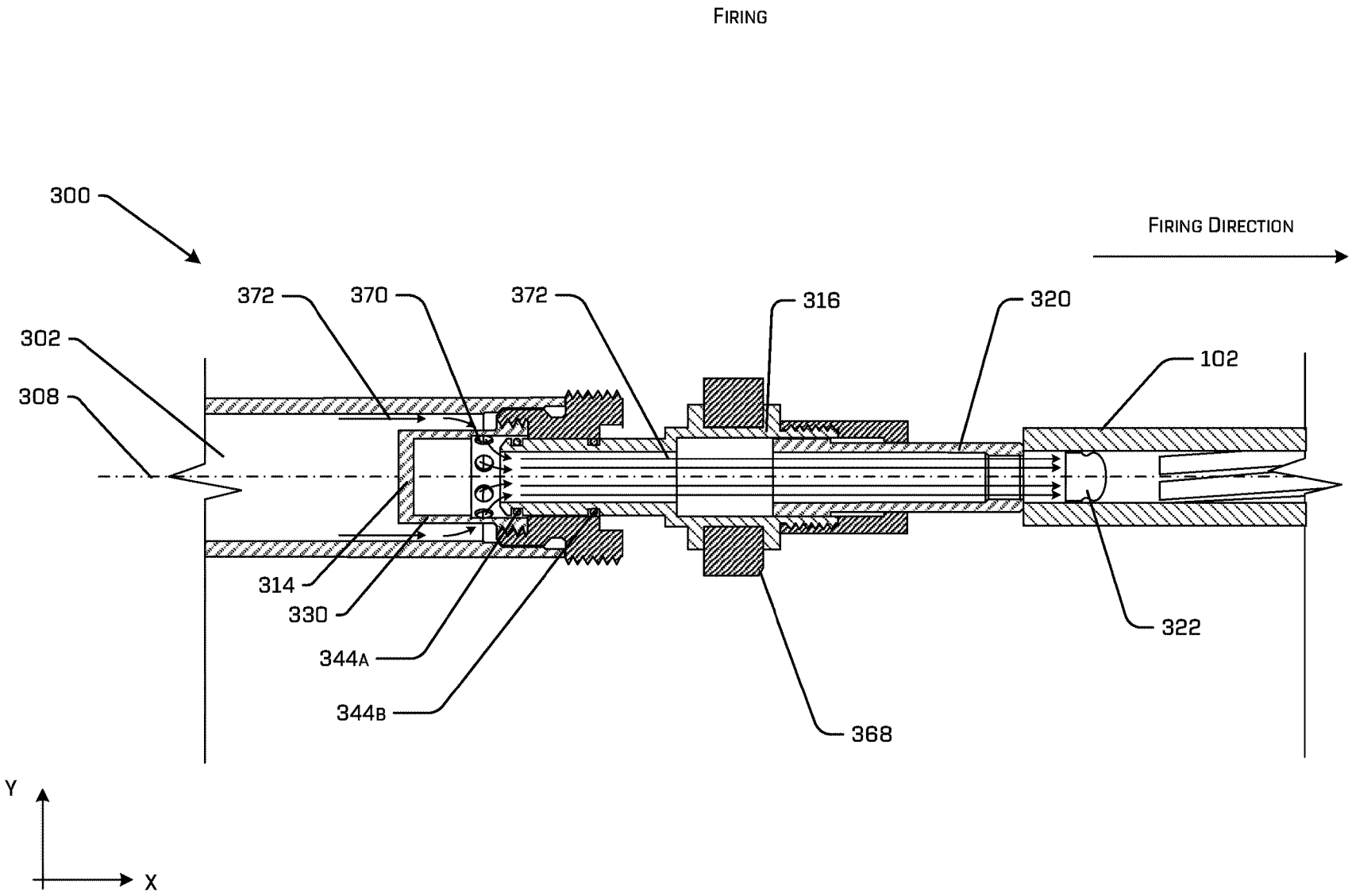

FIG. 3B shows another configuration in which the air gun including the valve assembly 300 has been fired. For example, the user of the air gun may have pulled the trigger, which has caused the sear to disengage from the searing surface 368. With the main spool 316 no longer retained by the sear, the biasing force from the air in the compressed air volume 302 causes the main spool 316 to move forward, e.g., in the firing direction. Although not illustrated in the figures, in some examples the main spool 316 may also or alternatively be biased in the firing direction by a biasing member, e.g., a spring or other component. For example, FIGS. 4A and 4B, discussed below, show an arrangement that incorporates a firing spring. A similar firing spring may also be used in the presently-discussed example.

As illustrated in FIG. 3B, movement of the main spool 316 relative to the valve body 314 exposes valve body openings 370 formed through the sidewall 330 of the valve body 314. Specifically, the first seal 334*a* sealing the main spool 316 to the inner surface of the valve body is advanced to a position relatively closer to the barrel 102, such that air from the compressed air volume 302 can flow into the valve body 314. The valve body openings 370 in the illustrated arrangement are a plurality of substantially circular openings formed about a circumference of the sidewall 330. However, this disclosure is not limited to the size, shape, and/or number of the openings 370 shown in FIG. 3B.

As shown in FIG. 3B, with the openings 370 exposed, the compressed air from the compressed air volume 302 is allowed to flow through the valve body 314, into and through the main spool 316, into and through the feed spool 320, and into and through the barrel 102, generally as shown by the arrows 372. In this manner, the projectile 322, which is disposed in the flow of the compressed air just described, is fired down the barrel 102 and from the air gun.

As noted above, in some examples, a diameter of the first inner surface 350 of the main spool 316, a diameter of the inner surface 364 of the feed spool 320, and an inner diameter of the barrel 102 may be substantially the same, e.g., to prevent any restriction to flow of the compressed air during the firing of the air gun as just described. That is, when the diameters are substantially the same, the discharged air will maintain relatively constant flow characteristics from entry into the main spool 216 to exiting the barrel 102. In examples, the relatively wider second inner surface 352 of the main spool 316 may have negligible effects on the flow characteristics. Also in examples, the sidewall 356 of the feed spool 320 proximate the first end 358 may be tapered, e.g., to smooth a transition for air passing from the second volume 348 into the feed spool volume 366. Moreover, the tapered inner surface proximate the second end 360 of the feed spool 320 may have negligible effects on the flow characteristics. Also in examples, the slight taper may act to increase pressure on the compressed air just prior to the air contacting the projectile 322, which may result in improved exit velocity, for example.

Also in some examples, the openings 370 may be configured so as to not restrict flow of the air exiting the compressed air volume 302. Without limitation, the openings 370 may be sized, shaped, and/or otherwise configured such that a volume of air that can flow through the openings 370 is substantially the same as or greater than a volume of air that can flow through the main spool 316, the feed spool 320, and/or the barrel 120. For example, when multiple of the openings 370 are present, as in the example of FIG. 3B, an aggregate opening size, e.g., the sum of the diameters of the openings 370, may be substantially equal to or greater than the diameter of the first inner surface 350 of the main spool 316, the diameter of the inner surface 364 of the feed spool 320, and/or the inner diameter of the barrel 102. Thus, examples of this disclosure provide a flow path through which compressed air can fire the projectile that is generally straight, e.g., along the longitudinal axis 308 and with minimal flow restrictions caused by varying orifice sizes.

As noted above, although the openings 370 are illustrated as circular openings in other examples the openings may be slits, slots, and/or otherwise sized and/or shaped. Moreover, although the openings 370 are illustrated as being disposed in the sidewall 330 of the valve body 314 in other examples the openings 370 may be also or alternatively formed through the end 332 of the valve body 314. In one example configuration, some of the openings 370 may be formed proximate a periphery of the end 332, e.g., proximate the sidewall 330, and the end 338 of the main spool may create a seal with the end 332 of the valve body, e.g., radially inward from the openings 370. Other arrangements also are contemplated, and may be appreciated by those having ordinary skill in the art with the benefit of this disclosure.

Figure 3C:
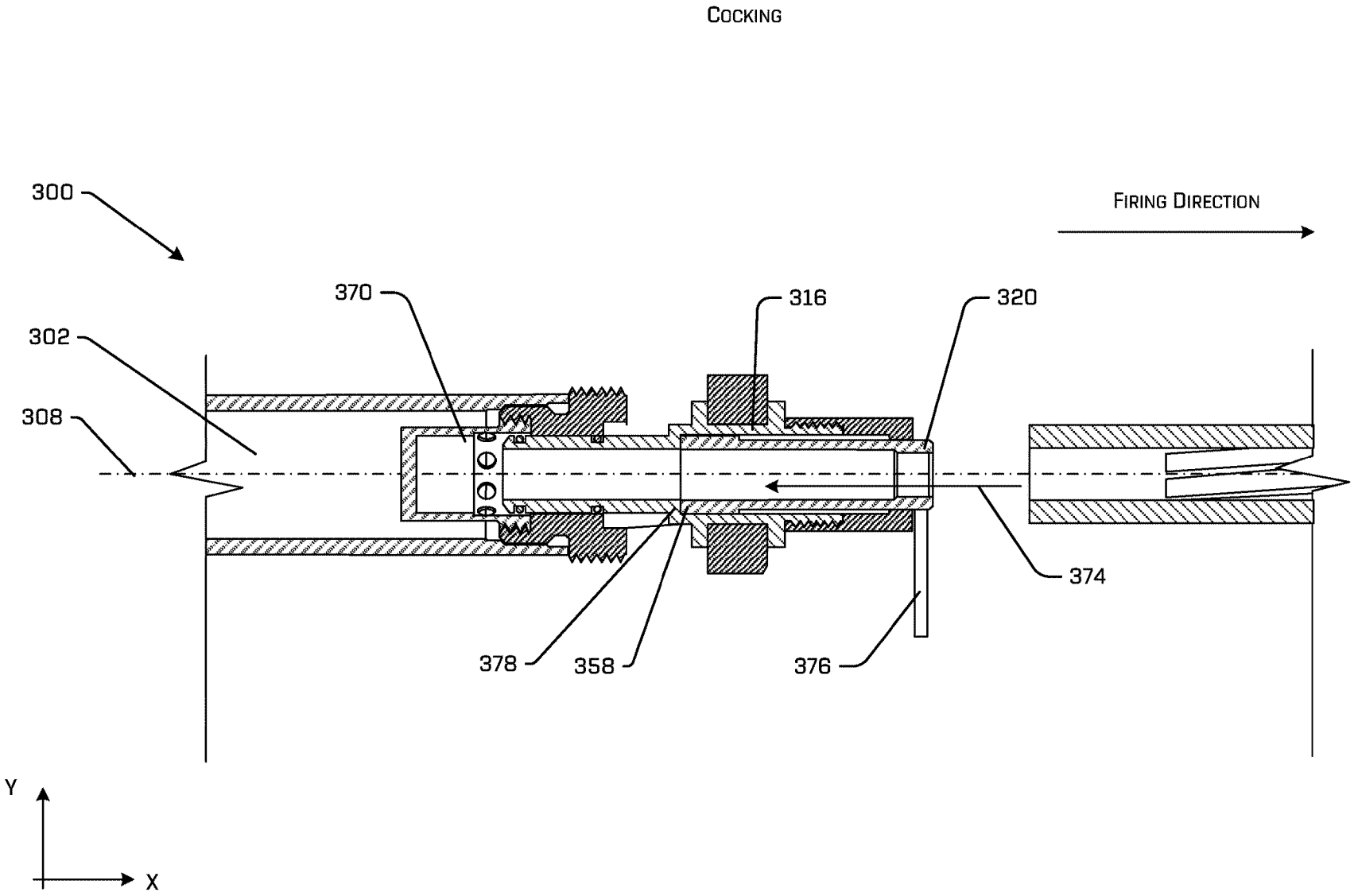

FIG. 3C shows another configuration in which the air gun including the valve assembly 300 is being cocked, e.g., to facilitate firing of another round (not shown). In the cocking configuration of FIG. 3C, the feed spool 320 has been moved in a cocking direction, generally represented by an arrow 374. As shown, the cocking direction is a direction opposite the firing direction.

FIG. 3C also schematically illustrates a user interface 376 that is coupled to the feed spool 320. The user interface 376 may comprise a bolt, a slide, or any other mechanism or combination of mechanisms that provides the user with an ability to move the feed spool 320 in the cocking direction shown by the arrow 374. In some examples, one or more mechanical, electromechanical and/or other components, including an actuator or the like, may be used, in combination with or instead of the user interface 376, to facilitate movement of the feed spool 320 in the cocking direction as shown in FIG. 3C.

As also shown in FIG. 3C, movement of the feed spool 320 is relative to the main spool 316. Accordingly, the first end 358 of the feed spool moves in the second main spool volume 348, e.g., toward the first end 338 of the main spool 316. Continued movement of the feed spool 320 relative to the main spool 316 will cause the first end 358 of the feed spool 320 to contact a step 378 formed at the interface of the first main spool volume 346 and the second main spool volume 348. In the example of FIG. 3C, the compressed air volume 302 is empty. For example, because the openings 370 are still exposed, a valve (like the fill valve 212 discussed above) may prevent the flow of compressed air into the compressed air volume 302, because that air would escape through the main spool 316 and the feed spool 320.

Figure 3D:
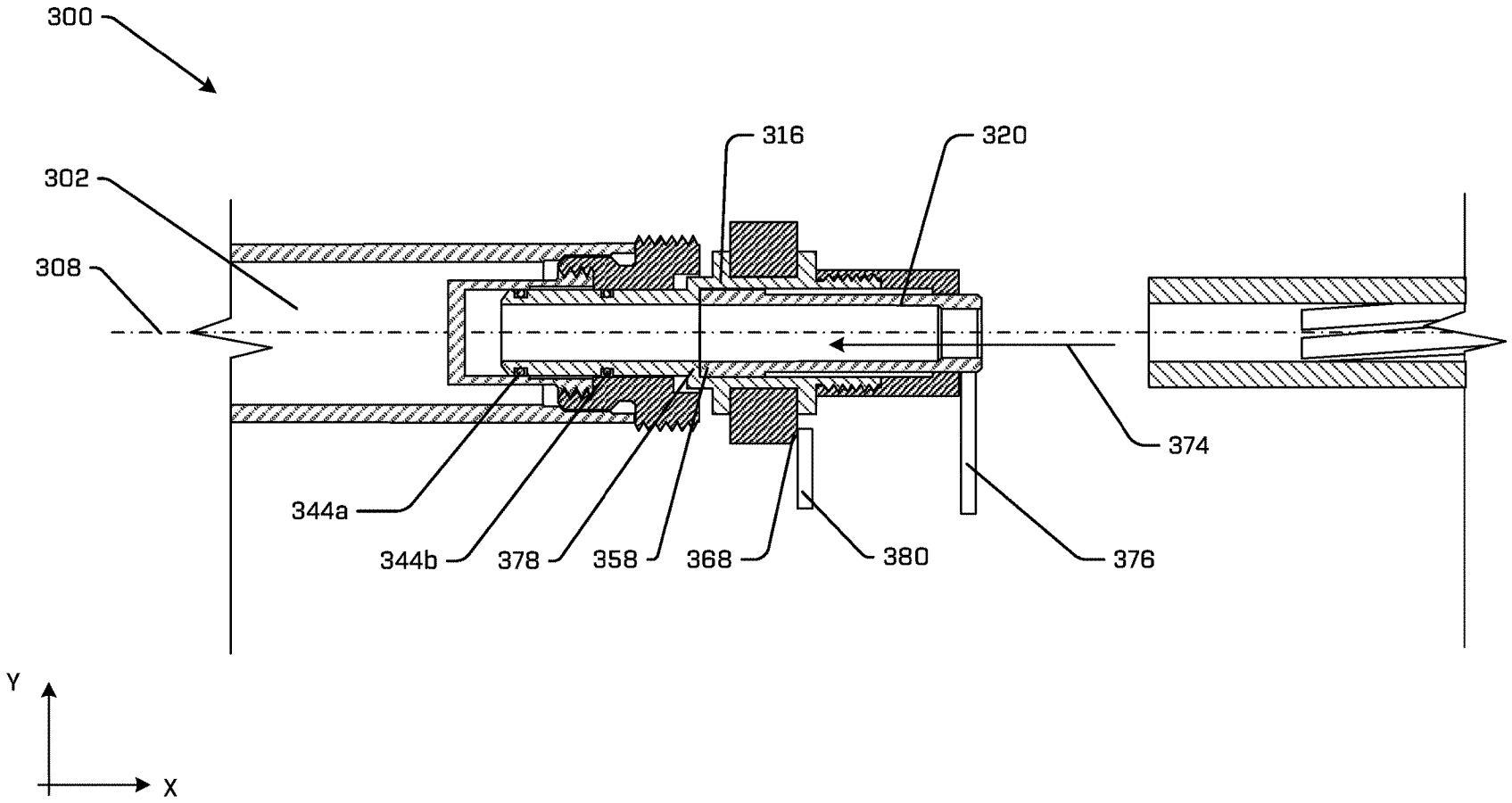

FIG. 3D shows another configuration in which the air gun including the valve assembly 300 is being seared and/or sealed, e.g., to further facilitate firing of another round (not shown). In the searing configuration of FIG. 3D, the feed spool 320 has continued to be moved in the cocking direction shown by the arrow 374. For example, a user may have continued to engage/move the user interface 376 in the direction of the arrow 374. With this continued movement, the contact between the first end 358 of the feed spool 320 and the step 378 causes the main spool 316 to also move in the direction of the arrow 374. With continued movement, the main spool 316 moves into a rearward position like the one in FIG. 3A. In this position, the seals 344*a*, 344*b* are arranged on opposite (longitudinal) sides of the openings 370, to effectively seal the openings 370 (no longer visible in FIG. 3D).

FIG. 3D also illustrates, schematically, a sear 380, which may be associated with a trigger assembly (not shown, but which may include the trigger 106). The sear 380 engages the searing surface 368 to prevent movement of the main spool 316 in the firing direction, as discussed above. In operation, the sear 380 may be biased into the position contacting the searing surface 368 e.g., via a spring or the like, when the main spool 316 (and thus the searing surface 368) is moved sufficiently rearward to "clear" or otherwise pas the sear 380. Other searing arrangements also are known, and may be incorporated.

In the configuration of FIG. 3D, the main spool 316 is seared in a position that seals the compressed air volume 302 relative to the valve body 314 (and the barrel 102). With the main spool 316 seared in the illustrated position, the compressed air volume 302 may be filled, e.g., from a compressed air source (not shown in FIG. 3D, but which may be the compressed air supply 202 discussed above).

Figure 3E:
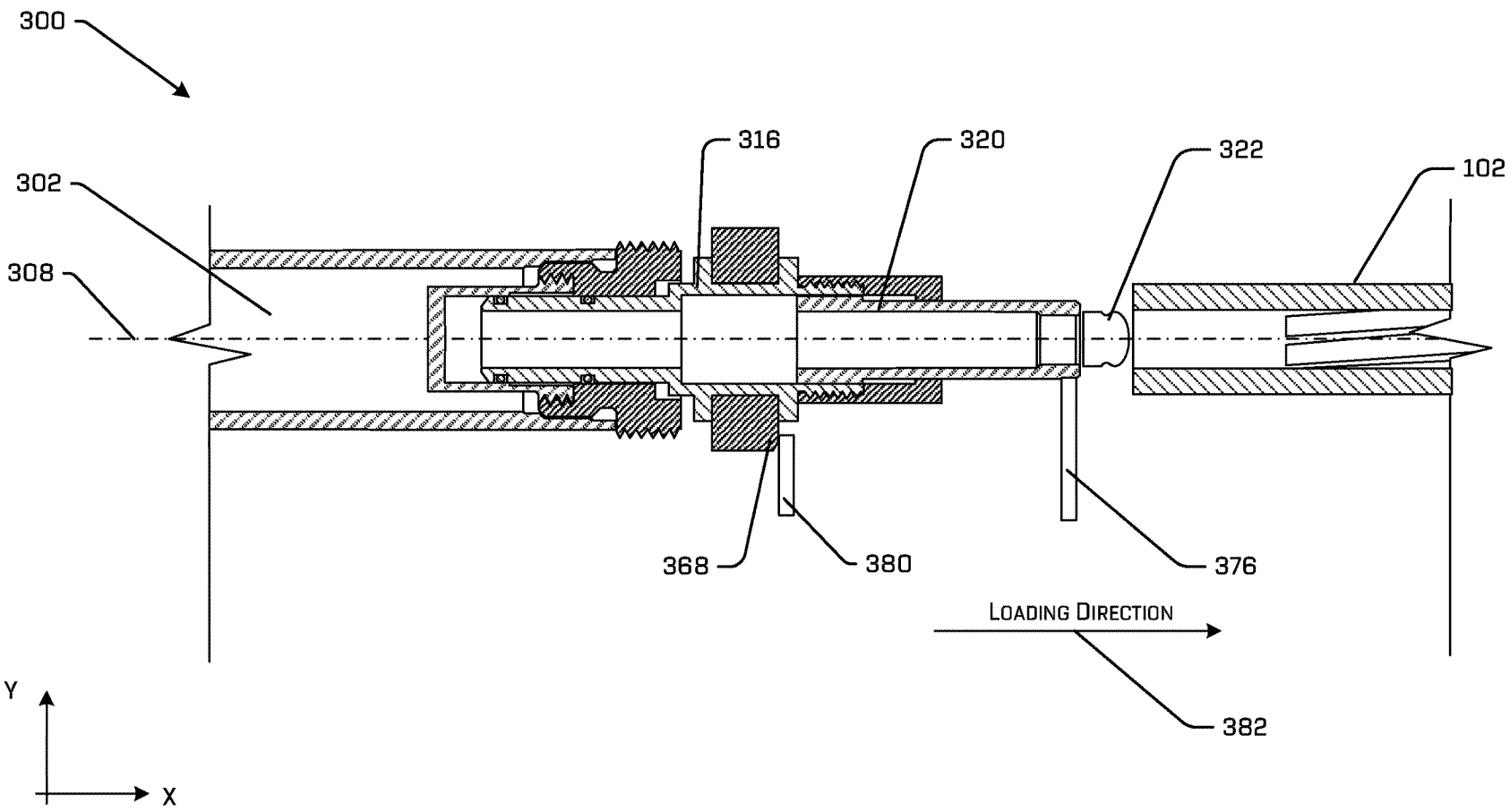

FIG. 3E shows another configuration in which the air gun including the valve assembly 300 is being loaded with an instance of the projectile 322, e.g., to further facilitate firing of the projectile 322. In the loading configuration of FIG. 3E, the feed spool 320 is moved in a loading direction generally along an arrow 382. The loading direction may correspond to the firing direction, for example. For example, a user may have reversed motion of the user interface, e.g., upon hearing, feeling, or otherwise confirming the searing/sealing shown in FIG. 3D. Because the main spool 316 is seared, e.g., at the interface of the searing surface 368 and the sear 380, the feed spool 320 moves relative to the main spool 316 in the loading direction shown by the arrow 382.

As also shown in FIG. 3E, an instance of the projectile 322 is placed in a position aligned with the barrel 102 and/or the feed spool 320. In the example, the projectile 322 is placed along the axis 308 proximate an opening of the barrel 102. In examples, the projectile 322 may be placed, e.g., manually by a user, into a receptacle that holds the projectile 322 generally as illustrated. In other instances, the projectile 322 may be held by a cartridge or other projectile holding and/or loading device that is configured to present the projectile 322 generally as illustrated.

Figure 3F:
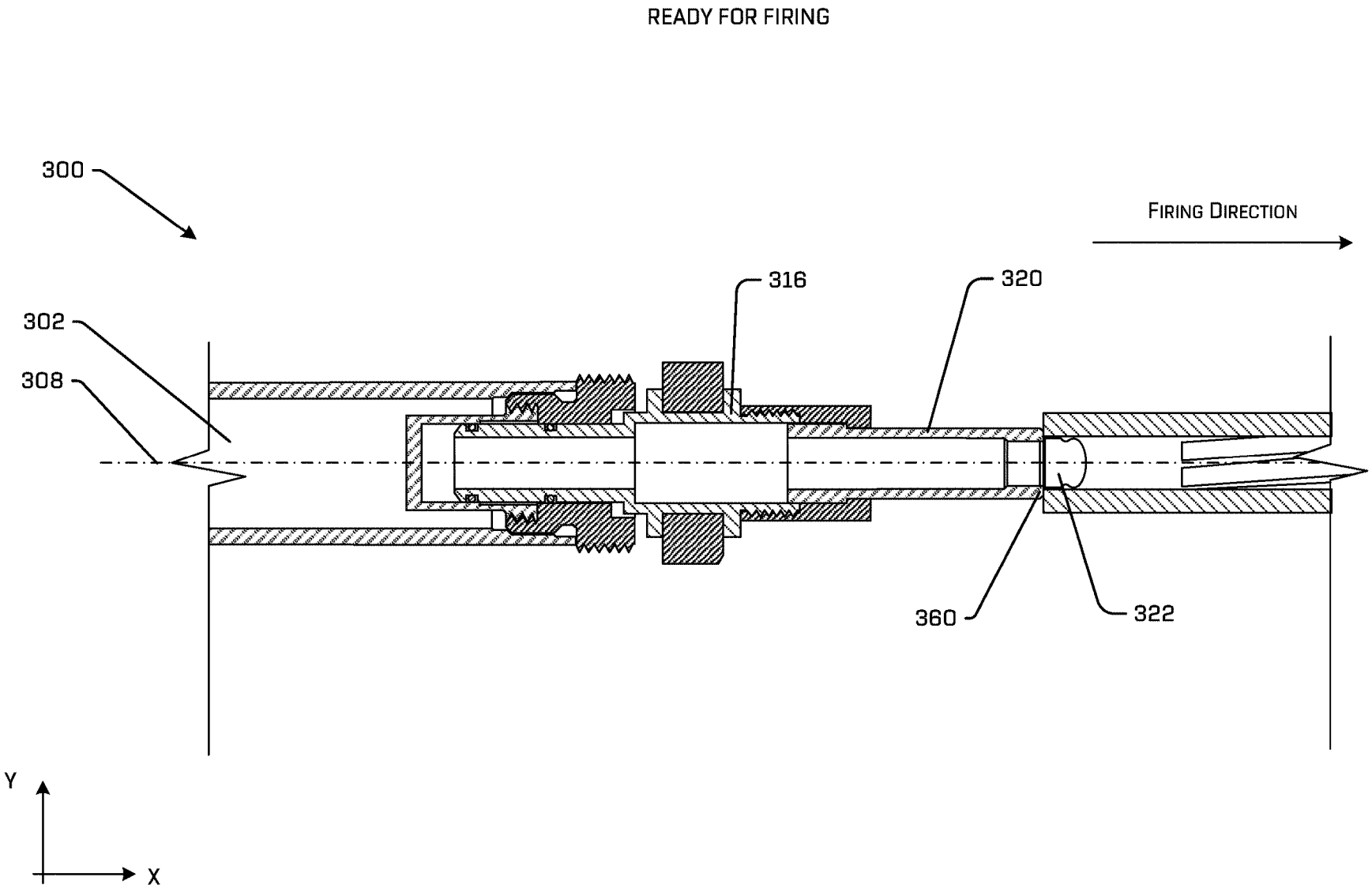

FIG. 3F shows a configuration in which the air gun including the valve assembly 300 is ready for firing. The configuration of FIG. 3F generally corresponds to the configuration of FIG. 3A, detailed above. In FIG. 3F, the feed spool 320 has been moved further in the loading direction (relative to FIG. 3E). As a result of this continued movement, the second end 360 of the feed spool 320 advances the projectile 322 into the barrel and contacts the barrel 102. Thus, in the configuration of FIG. 3F, the air gun is again ready for firing, e.g., in response to a trigger pull by a user.

Figure 4A:
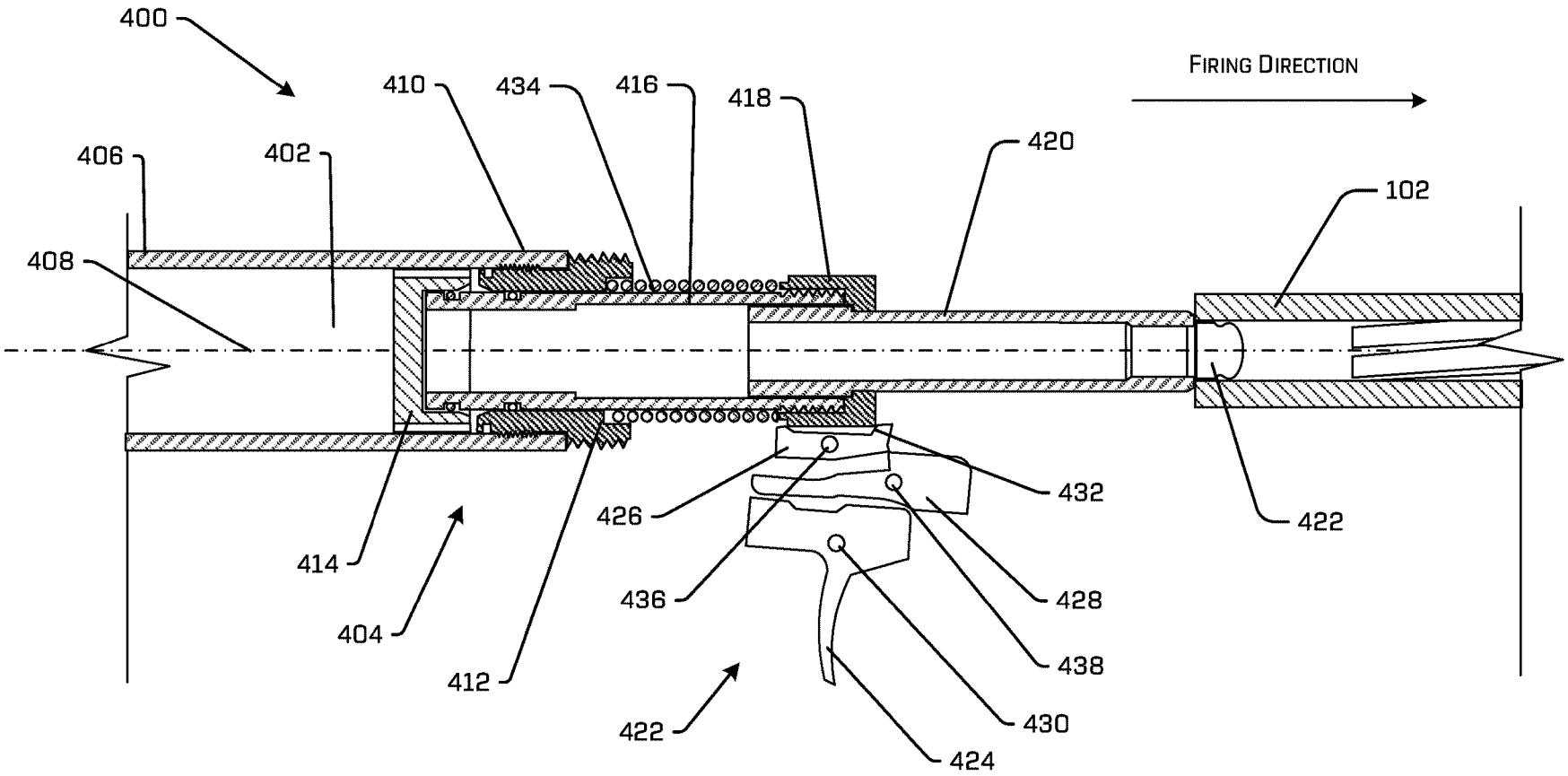
FIGS. 4A and 4B are side elevation views of aspects of an alternative valve assembly, illustrating steps of controlling aspects of an air gun according to example embodiments of this disclosure.
Figure 4B:
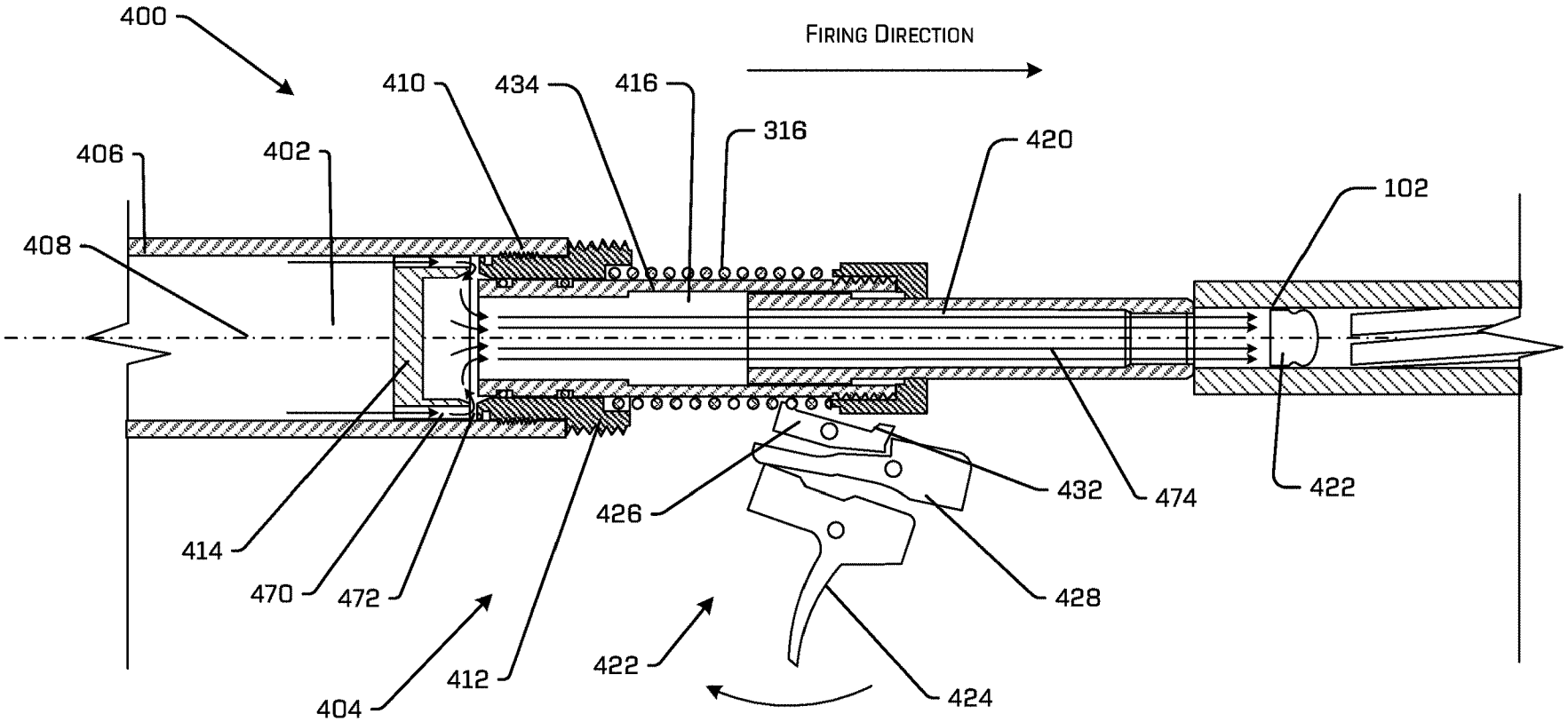

FIGS. 4A and 4B show an arrangement of an alternative example of a valve assembly 400. More specifically, FIGS. 4A and 4B are side views of aspects of a valve assembly 400 that may be incorporated in the air gun 100. For example, the valve assembly 400 may be an example of the valve assembly 204 shown schematically in FIG. 2 and/or may be used in place of the valve assembly 300 discussed above. FIG. 4A generally shows a "ready for firing" configuration, and FIG. 4B generally shows a "fired" configuration. The configurations of FIGS. 4A and 4B generally correspond to the configuration of FIGS. 3A and 3B, discussed above.

Referring first to FIG. 4A, the valve assembly 400 is illustrated as including a compressed air volume 402 and a spool valve assembly 404, which may generally correspond to the compressed air volume 208, 302 and the spool valve assembly 210, 304 discussed above, respectively. The compressed air volume 402 in FIG. 4A is at least partly defined by a cylindrical sidewall 406 extending generally along a longitudinal axis 408. The cylindrical sidewall 406 extends between a first, a first end 410, generally closer to the barrel 102, to an opposite, second end, not shown in FIG. 4A. The sidewall 406, the first end 410, and the second end generally define, at least in part, the compressed air volume 402. Although the compressed air volume 402 is generally illustrated as being formed by a cylinder, e.g., in which the sidewall 406 is a cylindrical sidewall, aspects of this disclosure are not limited to any specific shape or configuration. In examples, the sidewall 406 can comprise more than a single sidewall, e.g., angled or otherwise positioned relative to each other. In examples, the compressed air volume 402 may defined by any structure, component, assembly, or the like, that creates the compressed air volume 302 as an enclosed or substantially enclosed volume capable of retaining compressed air, as detailed further herein.

Although not shown in FIG. 4A, the compressed air volume 402 is in fluid communication with a compressed air supply, e.g., the compressed air supply 202 discussed above. In examples, one or more conduits, valves, and/or other components may be provided to facilitate transfer of compressed air from the compressed air supply to the compressed air volume 402.

The spool valve assembly 404 generally includes a collar 412, a valve body 414, a first, primary, or main spool 416, a spool mount 418, and a second, secondary, or feed spool 420. As with the valve assembly 300, detailed further above, the spool valve assembly 404 is configured to selectively allow the compressed air contained in the compressed air volume 402 to pass through the spool valve assembly 404 and escape through the barrel 102, forcing a pellet or other projectile 422 disposed in the firing path of the barrel 102 to be fired from the barrel 102. In some examples, substantially all of the compressed air in the compressed air volume 402 escapes during the firing of the air gun.

The collar 412, the valve body 414, the primary spool 416, the spool mount 418, and the secondary spool 420 generally correspond to the valve collar 312, the valve body 314, the primary spool 316, the spool mount 318, and the secondary spool 320, respectively, discussed above. Those features will not be discussed again in detail here, although differences from the valve assembly 400 will be highlighted.

FIG. 4A also includes a trigger assembly 422. The trigger assembly 422 includes a trigger 424, a sear 426, and a trigger linkage 428. The trigger 424 is positioned for interaction with a user. For example, the trigger 424 may be configured to rotate about a pivot 430, e.g., in response to a pulling force applied by a user. The sear 426 includes a searing surface 432. The searing surface 432 may be provided to interact or cooperate with the spool mount 418. Specifically, in the "ready for firing" configuration of FIG. 4A, the searing surface 432 contacts a leading edge of the spool mount 418 to retain the spool mount against a biasing force of a firing spring 434. Although not illustrated, a user interface may be provided that can apply a force, during cocking, to the spool mount that overcomes the biasing force of the firing spring 434. The sear 426 is configured to move about a pivot 436, and the trigger linkage 428 is configured to transfer a force generated by actuator of the trigger 424 to move the sear 426 about the pivot 436. In the example, the trigger linkage 428 is configured to rotate about a pivot 438.

In the arrangement of FIG. 4A, as in the arrangement of FIG. 3A, as discussed above, the primary spool 416 is positioned at least partially in the valve body 414, to prevent the flow of compressed air from the compressed air volume 402. Also in FIG. 4A, the secondary spool 420 is advanced, e.g., in the firing direction, to contact the barrel 102. Accordingly, the internal surfaces of the primary spool 416 and the secondary spool 420 define a flow path.

FIG. 4B shows another configuration in which the air gun including the valve assembly 400 has been fired. In the illustration, the trigger 424 has been actuated, e.g., in a clockwise direction, which has caused the sear 426 to disengage from the spool mount 418 (by also moving in the clockwise direction. With the main spool 416 no longer retained by the sear 426, the biasing force from the firing spring 434 and/or from the air in the compressed air volume 402 causes the main spool 416 to move forward, e.g., in the firing direction.

As illustrated in FIG. 4B, movement of the main spool 416 relative to the valve body 414 exposes valve body openings 470 formed as channels in a sidewall of the valve body 414. The body openings 470 define fluid passageways between the sidewall 406 and the valve body 416, e.g., along an axial length of the valve body 416. Specifically, movement of the main spool 416 causes a first seal sealing the main spool 146 to the inner surface of the valve body to advance to a position relatively closer to the barrel 102, such that air from the compressed air volume 402 can flow through the channels 470, past the valve body 414, and into an exposed gap 472 between the valve body 414 and the collar 412. The channels 470 in the illustrated arrangement are a plurality of substantially semi-circular grooves spaced about a circumference of the sidewall of the valve body 414. However, this disclosure is not limited to the size, shape, and/or number of the openings channels 470 shown in FIG. 4B.

As shown in FIG. 4B, with the openings 370 and the gap 472 exposed, the compressed air from the compressed air volume 402 is allowed to flow through the valve body 414, into and through the main spool 416, into and through the feed spool 420, and into and through the barrel 102, generally as shown by the arrows 474. In this manner, the projectile 422, which is disposed in the flow of the compressed air just described, is fired down the barrel 102 and from the air gun.

As with the examples described above, inner diameters of the main spool 416, of the feed spool 420, and of the barrel 102 may be substantially the same, e.g., to prevent any restriction to flow of the compressed air during the firing of the air gun as just described. That is, when the diameters are substantially the same, the discharged air will maintain relatively constant flow characteristics from entry into the main spool 416 to exiting the barrel 102.

Also in some examples, the openings 470 and the gap 472 may be configured so as to not restrict flow of the air exiting the compressed air volume 402. Without limitation, the openings 470 may be sized, shaped, and/or otherwise configured such that a volume of air that can flow through the openings 470 is substantially the same as or greater than a volume of air that can flow through the main spool 416, the feed spool 420, and/or the barrel 120. For example, when multiple of the openings 470 are present, as in the example of FIG. 4B, an aggregate opening size, e.g., the sum of the cross-sectional areas of the openings 470, may be substantially equal to or greater than the cross-sectional area of an inner surface of the main spool 416, the cross-sectional area of the inner surface of the feed spool 420, and/or the cross-sectional area of the barrel 102. Similarly, the gap 472 may be sized to have an effective area that equals or exceeds that of downstream portions of the flow path defined by the main spool 416, the secondary spool 420, and the barrel 102. Thus, examples of this disclosure provide a flow path through which compressed air can fire the projectile that is generally straight, e.g., along the longitudinal axis 408 and with minimal flow restrictions caused by varying orifice sizes.

As noted above, although the openings 470 are illustrated as semi-circular slots, in other examples the openings may be slits, holes, and/or otherwise sized and/or shaped. Moreover, although the openings 470 are illustrated as being disposed in the sidewall of the valve body 414 in other examples the openings 470 may be also or alternatively formed through an end of the valve body 414. Other arrangements also are contemplated, and may be appreciated by those having ordinary skill in the art with the benefit of this disclosure.

The subject matter described above is provided by way of illustration only and should not be construed as limiting. Furthermore, the claimed subject matter is not limited to implementations that solve any or all disadvantages noted in any part of this disclosure. Various modifications and changes may be made to the subject matter described herein without following the examples and applications illustrated and described, and without departing from the spirit and scope of the present invention, which is set forth in the following claims.

We claim:

1. An air gun comprising:

a barrel defining a firing axis;

a compressed air source in fluid communication with the barrel; and a valve assembly configured to selectively pass compressed air from the compressed air source to the barrel to fire a projectile, the valve assembly comprising:

a compressed air volume;

a valve comprising a substantially cylindrical valve body formed about a valve axis, the valve comprising one or more openings through the valve body in fluid communication with the compressed air volume;

a primary spool extending along the valve axis and movable relative to the valve body to selectively allow or prevent air from the compressed air volume to pass through the one or more openings; and a secondary spool extending along the valve axis and movable along the valve axis relative to the primary spool, the secondary spool being disposed at least partially inside the primary spool and comprising a leading surface that contacts the barrel, wherein at least a portion of the primary spool and the secondary spool define a fluid passageway for directing air entering the valve through the one or more openings to the barrel.

2. The air gun of claim 1, wherein:

the one or more openings define an opening that is equal to or larger than an inner diameter of at least one of the primary spool, the secondary spool, or the barrel.

3. The air gun of claim 1, wherein:

the one or more openings comprise a plurality of openings arranged circumferentially about the valve body.

4. The air gun of claim 1, further comprising:

a sear associated with the primary spool and cooperating with a trigger to retain the primary spool in a cocked position.

5. The air gun of claim 4, further comprising:

an actuator configured to impart a biasing force on the main spool, in a firing direction, toward the barrel;

wherein the sear retains the primary spool in the cocked position against the biasing force.

6. The air gun of claim 1, wherein:

the primary spool includes a first inner diameter over a first portion of a length of the primary spool and a second inner diameter larger than the first inner diameter over a second portion of the length of the primary spool.

7. The air gun of claim 6, wherein the secondary spool has an outer diameter that is larger than the first inner diameter of the primary spool and smaller than the second inner diameter of the primary spool, at least a portion of second spool being circumscribed by the second portion of the length of the primary spool.

8. The air gun of claim 7, wherein the secondary spool has an inner diameter that is substantially the same as the first inner diameter of the primary spool.

9. The air gun of claim 8, wherein an inner diameter of the barrel is substantially the same as the inner diameter of the secondary spool and the first inner diameter of the primary spool.

10. The air gun of claim 1, further comprising:

a compressed air source spaced from the compressed air volume; and a valve configured to selectively allow air from the compressed air source into the compressed air volume.

11. A valve assembly for an air gun, the valve assembly comprising:

a compressed air volume;

a valve comprising a valve body formed about a longitudinal axis, the valve comprising one or more openings through the valve body in fluid communication with the compressed air volume;

a primary spool movable relative to the valve body, the primary spool movable between a first position that prevents air from the compressed air volume from passing through the one or more openings and a second position that allows air from the compressed air volume to pass through the one or more openings; and a secondary spool movable relative to the primary spool, the secondary spool being disposed at least partially inside the primary spool, wherein at least a portion of the primary spool and the secondary spool define a fluid passageway for directing air entering the valve through the one or more openings to a barrel of the air gun.

12. The valve assembly of claim 11, wherein:

the one or more openings define an aggregate opening that is equal to or larger than an inner diameter of at least one of the primary spool, the secondary spool, or the barrel.

13. The valve assembly of claim 11, wherein:

the one or more openings comprise a plurality of openings arranged circumferentially about the valve body.

14. The valve assembly of claim 11, wherein the primary spool has a sear surface configured for engagement by a sear and the sear cooperates with a trigger to retain the primary spool in the first position.

15. The valve assembly of claim 14, wherein the primary spool is configured to be contacted by an actuator that imparts a biasing force on the main spool, in a firing direction, toward a barrel;

wherein the sear retains the primary spool in a seared position against the biasing force.

16. The valve assembly of claim 11, wherein:

the primary spool includes a first inner diameter over a first portion of a length of the primary spool and a second inner diameter larger than the first inner diameter over a second portion of the length of the primary spool.

17. The valve assembly of claim 16, wherein the secondary spool has an outer diameter that is larger than the first inner diameter of the primary spool and smaller than the second inner diameter of the primary spool, at least a portion of second spool being circumscribed by the second portion of the length of the primary spool.

18. The valve assembly of claim 17, wherein the secondary spool has an inner diameter that is substantially the same as the first inner diameter of the primary spool.

19. The valve assembly of claim 18, wherein:

a leading edge of the secondary spool is configured to contact an edge of a barrel of the air gun; and an inner diameter of the barrel is substantially the same as the inner diameter of the secondary spool and the first inner diameter of the primary spool.

20. The air gun of claim 11, wherein:

the compressed air volume is configured to receive a predetermined amount of compressed air from a compressed air source.

* * * * *